United States Patent [19]

Morrison et al.

[11] 4,104,730

[45] Aug. 1, 1978

[54] BORESIGHT ADJUSTMENT FOR A HARMONIC OSCILLATOR COORDINATE CONVERTER

[75] Inventors: Steven Morrison, Baltimore; William J. Dorman, Ellicott City, both of Md.

[73] Assignee: Westinghouse Electric Corp., Pittsburgh, Pa.

[21] Appl. No.: 672,894

[22] Filed: Apr. 2, 1976

[51] Int. Cl.[2] ..... G06G 7/22; G06G 7/80

[52] U.S. Cl. ..... 364/815; 89/41 EA; 235/410; 364/603

[58] Field of Search ..... 235/197, 186, 189, 150.25, 235/150.26, 150.27, 61.5 R, 61.5 E, 61.5 G, 61.5 S, 61.5 T, 150.53; 89/37.5 C, 41 E, 41 EA, 41 CE, 1.5 S, 1.5 E; 340/347 SY; 244/14; 331/53, 76; 328/16, 17, 18; 33/229, 230, 233, 234, 235, 236

[56] References Cited

U.S. PATENT DOCUMENTS

| | | | |
|---|---|---|---|
| 2,995,302 | 8/1961 | Ingwerson et al. | 235/189 X |
| 3,371,199 | 2/1968 | Schwartzenberg et al. | 235/189 |
| 3,415,157 | 12/1968 | Marchisio et al. | 89/41 E |
| 3,803,387 | 4/1974 | Lackowski | 235/61.5 S X |
| 3,829,659 | 8/1974 | Margolis | 235/61.5 S |

*Primary Examiner*—Joseph F. Ruggiero
*Attorney, Agent, or Firm*—R. M. Trepp

[57] ABSTRACT

A harmonic oscillator coordinate converter in combination with analog and digital circuits is described which may accept signals indicative of a measured angle and of a misalignment angle to provide coordinate conversions of a vector through the measured angle and the misalignment angle during a single angle transformation.

11 Claims, 12 Drawing Figures

BORESIGHT ADJUSTMENT FOR A HARMONIC OSCILLATOR COORDINATE CONVERTER

GOVERNMENT CONTRACT

The invention herein described was made in the course of or under a contract or subcontract thereunder with the Department of the Air Force.

CROSS-REFERENCE TO RELATED APPLICATION

This application is cross-referenced to U.S. Patent Application Ser. No. 672,893, now U.S. Pat. No. 4,047,014 entitled "Improved Coordinate Converter" by S. Morrison and G. A. Williams, filed on April 2, 1976 concurrently herewith and assigned to a common assignee containing the subject matter of an electronic coordinate converter where the inventive feature is directed towards shifting the transition point of the oscillation angle in the electronic coordinate converter.

BACKGROUND OF THE INVENTION

1. Field of the Invention

This invention relates to electronic coordinate converter apparatus, particularly to electronic harmonic oscillator coordinate converters.

2. Description of the Prior Art

In a typical airborne application a system will measure individual angles of a vector with respect to a reference line or coordinate system which may be slightly displaced angularly or off boresight from the desired reference line. The angular displacement may rise from mechanical misalignment which may occur during installation of the system. A vector may be subsequently transformed through the measured angle to another coordinate system using a harmonic oscillator coordinate converter while retaining the angular displacement error.

A harmonic oscillator coordinate converter is used to rotate a vector through an angle from one coordinate system to another. This may occur for example when information such as the direction of a target is provided in geographic coordinates X, Y, Z, and is desired in relation to the sensor coordinates I, J, K, so that the sensor may be directed or pointed in the direction of the target. The transformation of a vector from one coordinate system to another may be accomplished with electronic apparatus described in U.S. Pat. No. 3,473,011, issued to H. Schmid, which does not suggest a means for boresight alignment.

In a moving aircraft the direction from the aircraft to the target is continually changing due to the motion of the aircraft. If a sensor is directed at a target, the pointing direction or vector must be continually updated with a new pointing angle in order to keep the sensor directed at the target while the airplane is moving. In tracking a target, the direction in geographic coordinates X, Y, Z, is continually transformed to the sensor coordinates I, J, K so that the sensor may be continually directed at a target.

In the past, sensor systems were mechanically aligned with a reference line on the aircraft by testing the system for alignment and by making mechanical adjustments. Some sensor systems are now being suspended from a wing of an aircraft in a pod with little or no time for mechanical alignment. The pod is rigidly connected to the wing with two rings extending from the pod and bolted to two ferrules attached to the wing. In this arrangement, a pod may be easily attached or removed from a wing of an airplane, or a pod may be interchanged with another pod in a short amount of time. Two side braces extending from the wing to the pod prevent lateral motion of the pod. However, due to mechanical alignment variations incurred by mounting the pod to the wing, and by mechanical variations between airplanes and pods, the sensor would invariably be misaligned with the reference line of the airplane upon which the other systems would be aligned. The mechanical misalignment was angular in nature and sufficient to require correction either mechanically or electrically. A mechanical correction could be made by unbolting the pod and inserting spacers to align the pod with the reference line. An electrical correction could be made by biasing off the comparator which detects the zero crossing of $e_2(t)$ during the first rotation period of the harmonic oscillator. The shortcoming of this method is that the modulus (A) of $E_2$ during this period is not precisely known which caused direct error in the boresight correction angle since the correct scaling of the signal is not known. Another electrical method of correction was to measure the misalignment angle and to transform the vector through the misalignment angle after transforming the vector through the desired angle. The disadvantage of this approach was that since two angles were being serially transformed, the time and error incident to each angle transformation were added together or doubled. The result was that the rate of updating the direction of the sensor to a target was reduced and that the error in directing a sensor to a target was increased.

SUMMARY OF THE INVENTION

In accordance with the present invention, electronic apparatus is described for transforming a vector through a corrected angle from one coordinate system to another where an angle is measured with reference to a first coordinate system which is angularly misaligned with a second coordinate system. An electronic coordinate converter means which includes means for accepting signals indicative of an angular misalignment is provided for electrically transforming the vector through the measured angle and adjusting the transformation during a single angle transformation time to compensate for the angular misalignment. The arrangement allows for angular transformation at an optimum rate while preventing accumulated error due to multiple angle transformations.

DESCRIPTION OF THE PREFERRED EMBODIMENTS

Figure 1:
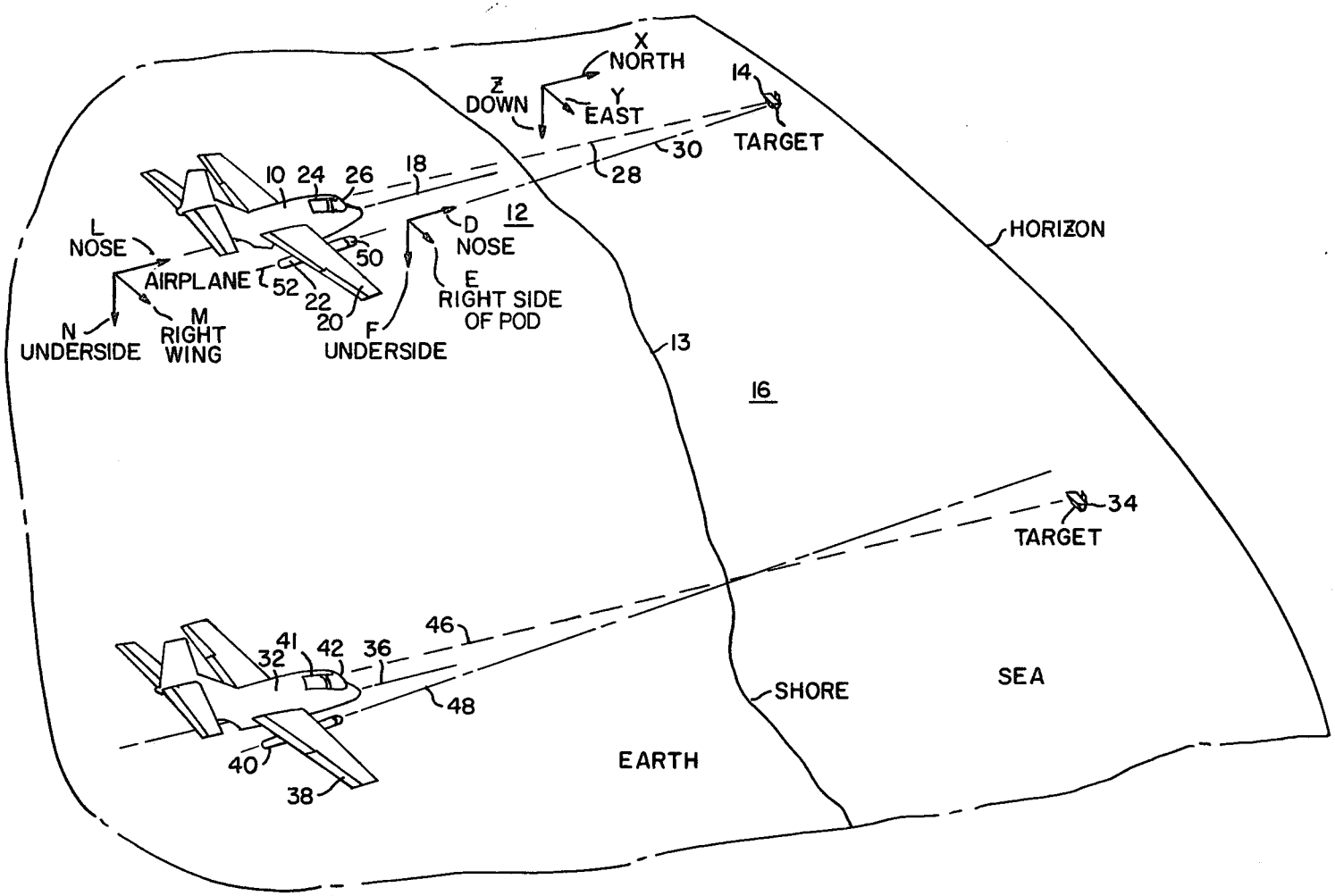
FIG. 1 is a view illustrating the line of sight paths from an airplane and an attached sensor to a target.

Referring to FIG. 1, airplane 10 is shown flying over earth 12 and pointed towards a target 14 which is in the sea 16 and separated from the earth 12 by a shore 13. Airplane 10 has a reference line 18 which passes fore and aft through the center of the fuselage. A pod 22 is attached to airplane wing 20 such that the pod is immovable or stationary with respect to the wing 20 and the reference line 18. A rigid connection between the pod 22 and the wing 20 is typically made by attaching eyelets or ferrules to the top side of the pod in the fore and aft position and bolting these ferrules to corresponding eyelets or ferrules attached to the wing 20. Lateral motion of the pod with respect to reference line 18 is prevented by side brackets attached to wing 20 and to pod 22 on either side of pod 22. A ringsight 26 is located in cockpit 24 shich is in alignment with reference line 18. When the airplane 10 is directed towards target 14 a pilot is able to look through ringsight 26 which is likewise directed at target 14. Line of sight 28 connecting ringsight 26 and target 14 shows that the airplane 10 is directed towards target 14. Pod 20 contains a sensor or weapon system which is directed at target 14 by electrical signals. One example of a sensor directed at a target would be a mirror mounted on a two gimbal axis platform, each gimbal being driven by a torquing motor such that the line of sight 30 from target 14 would be received by the mirror and reflected into the camera optical system.

Airplane 32 is shown flying above earth 12 and directed towards target 34 which is in the sea 16. Reference line 36 is shown passing fore and aft through the center of the fuselage. Wing 38 is shown with pod 40 which is attached in a similar manner as pod 22. Cockpit 41 is shown with ringsight 42 which is aligned with reference line 36. The line of sight 44 is aligned with reference line 36 and passes from the ringsight 44 to the target 34. Pod 40 contains a sensor or weapon system which is directed by electrical signals. The electrical signals received by pod 40 are referenced to reference line 36. If pod 40 is attached to the wing in a manner which results in the misalignment of the sensor or weapon system within pod 40 to reference line 36, the misalignment will show the line of sight 43 which is directed in the direction of target 34 but which misses target 34 due to the mechanical misalignment of pod 40 for example. The misalignment is due to the fact that the electrical signals were generated with the presumption that the pod 40 and the system within was aligned with reference line 36 of the airplane. Certain situations exist where time does not allow for the mechanical alignment of a pod during installation.

Figure 2:
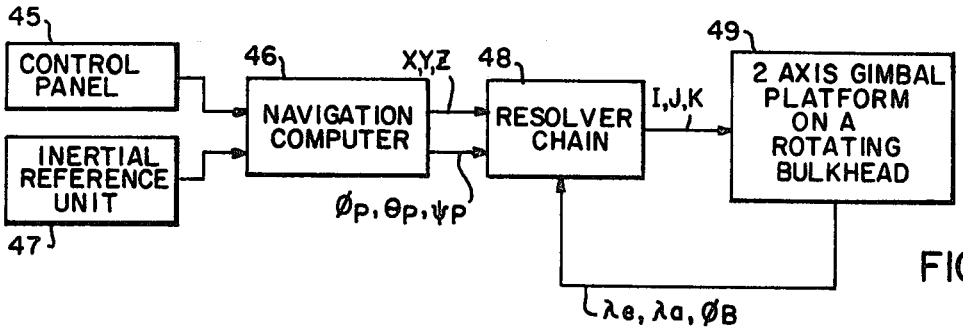
FIG. 2 shows in block diagram the arrangement of apparatus for directing a sensor towards a target.

FIG. 2 shows in block diagram the arrangement of apparatus on an airplane for directing a sensor towards a target. The geographic coordinates of a target are inserted into the control panel 45. Inertial reference unit 47 supplies update information to the navigation computer 46 about the motion of the airplane, such as velocity and acceleration. The navigation computer 46 calculates the present geographic coordinates of the airplane which are subtracted from the target geographic coordinates to produce the relative target location. The relative location in the form of vector components X, Y, Z is sent to resolver chain 48. In addition, the navigation computer transfers to the resolver chain 48 angular information with respect to the heading, pitch and roll of the airplane with respect to geographic coordinates. The resolver chain 48 also receives sensor angular information in aircraft coordinates and converts the line of sight direction from geographic coordinates X, Y, Z to sensor coordinates I, J, K. The torquing motors attached to the two axis gimbal platform and rotating bulkhead 49, which are located in the nose of pod 22, as shown in FIG. 1, are driven so as to null the J and K components of the vector. The resolver chain performs a sequence of transformations where each transformation is performed with an electronic coordinate converter. Each transformation is performed through one measured angle which represents the relationship of one coordinate system to another. The apparatus in FIG. 2 operates on a continual basis to provide an updated pointing vector to the two axis gimbaled platform and rotating bulkhead 49 so that the sensor may be pointed at the target.

Figure 3:
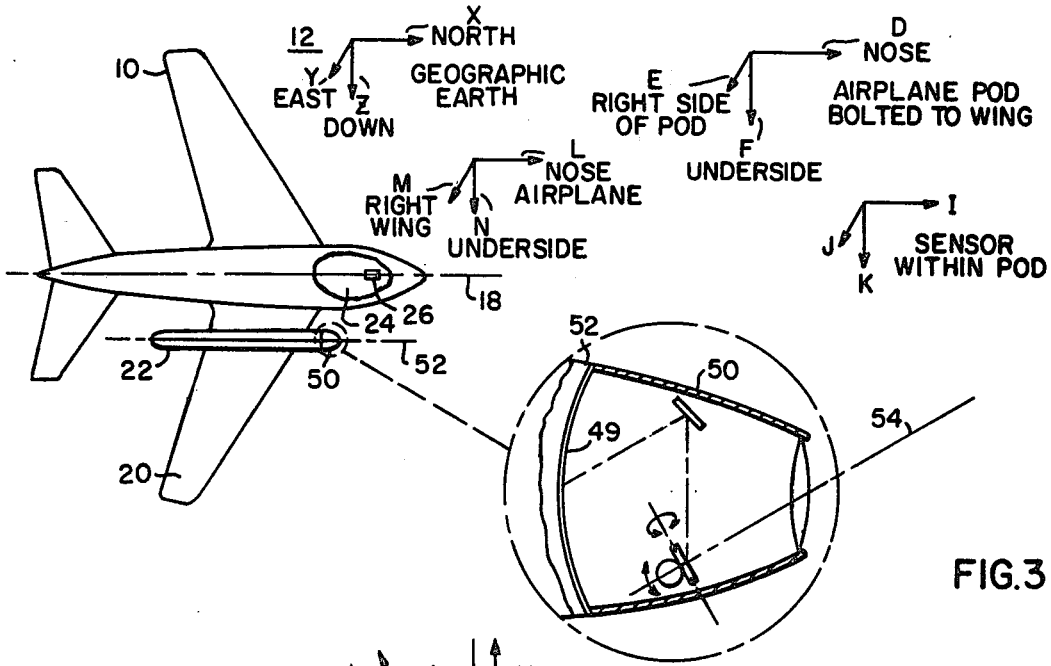
FIG. 3 shows several coordinate systems with reference to an airplane, pilot, and sensor.

FIG. 3 shows airplane 10 with reference line 18 in top view showing pod 22 under wing 20. Pod 22 has a reference line 52 which passes through the center of pod 22 in the lengthwise or fore and aft direction. The forward portion of pod 22 contains sensor 50 which has a reference line 54 and is mounted on a two axis gimbal platform and rotating bulkhead 49.

Various coordinate systems such as geographic earth, airplane, airplane pod, and sensor have been developed to facilitate the description of motion and direction. For example, a pilot may move his finger in a circle orthogonal to the reference line 18 in a moving airplane. The circular motion would describe a circle with reference to the airplane coordinates. The circular motion would describe a helix with reference to the geographic earth coordinates. In FIGS. 1 and 3 earth 12 is shown with geographic coordinates X pointing in the north direction, Z pointing in the downward position, and Y pointing in the east direction. Coordinates for the airplane are shown as L which runs along the reference line 18, N which points downward from the cockpit position in the airplane, and M which is orthogonal L and N and points out the right side of the airplane when facing forward in the cockpit. Coordinates for the pod are shown as reference line 52 for the direction D. F is in the downward position from the pod opposite from the support eyelets and E is orthogonal to F and D and pointing out the right side of pod 22 when facing forward in the direction of the sensor package. The sensor 50 has a coordinate I pointing in the direction of reference line 54, coordinate K pointing downward and orthogonal to reference line 54, and coordinate J pointing to the right side and orthogonal to reference line 54 when facing forward in the direction of the target. The advantage of using several of the four coordinate systems, as shown in FIG. 3 is that particular or selected motion and direction may be described with reference to a selected coordinate system. The motion and angular alignment of the various coordinate systems are continuously measured allowing motion and direction vectors from one coordinate system to be converted into another coordinate system by an electronic coordinate converter with relative ease.

Figure 4:
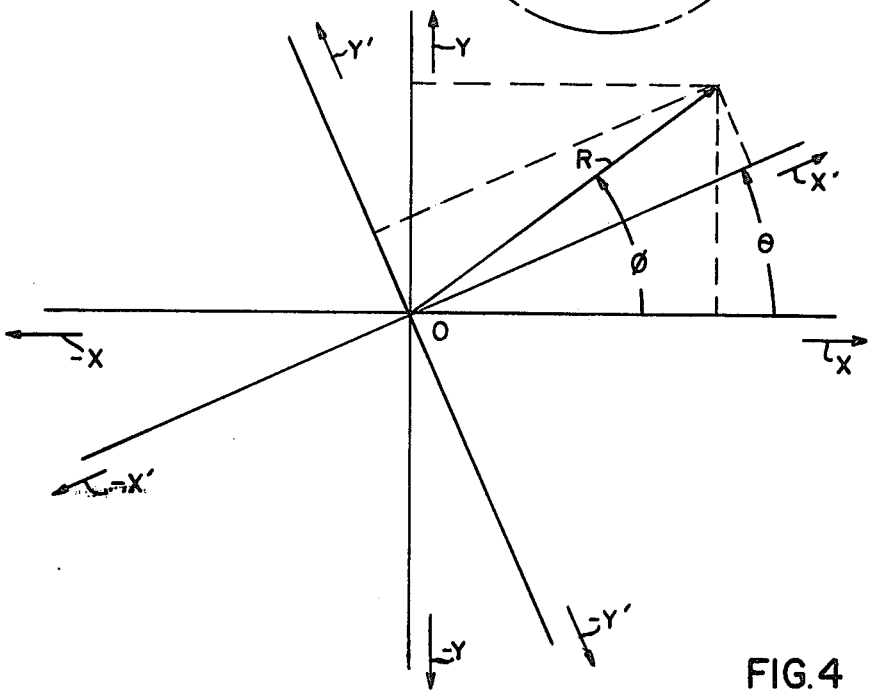
FIG. 4 is an illustration of a coordinate rotation through an angle theta.

The rotation of a coordinate system in one direction relative to a vector may be alternately described as the rotation of the vector in the other direction relative to the coordinate system by an equal amount. FIG. 4 shows the graphical effect of rotating a coordinate system through an angle $\theta$. R represents the original vector at angle $\theta$ and with coordinate values Y and X. Vector R after the coordingate system has been rotated through angle $\theta$ has new coordinate values Y' and X'. If the angle of rotation of the coordinate system is known along with the original values Y and X, the new coordinate values Y' and X' may be calculated as provided in Equations 1 and 2.

$$X' = X\cos\theta + Y\sin\theta \quad (1)$$

$$Y' = Y\cos\theta - X\sin\theta \quad (2)$$

The angle $\theta$ in FIG. 4 represents the measured angle of rotation of one coordinate system with respect to another. The measurement of one coordinate angle may be made by the means of a synchro connected to the axis of rotation in one coordinate system and referenced to another system. The synchro would provide an electrical signal indicative of the rotation. Alternately, the movement or rotation of a coordinate system with respect to another coordinate system may be measured by an inertial reference unit which would provide signals indicative of motion and of angular rotation. While motion and angles in a coordinate system may be accurately measured with respect to another coordinate systems, errors may arise due to angular displacement or misalignment of the measuring apparatus in one of the coordinate systems. In other words the angles are measured with respect to the measuring equipment or instruments and if the instruments are not perfectly aligned with the coordinate system errors will arise. If the instrument measuring the angle $\theta$ is misaligned slightly with the coordinate X as shown in FIG. 5 then a correction of $\Delta\theta$ should be added to the measured angle $\theta$ to transform the vector R from one coordinate system to another.

Figure 5:
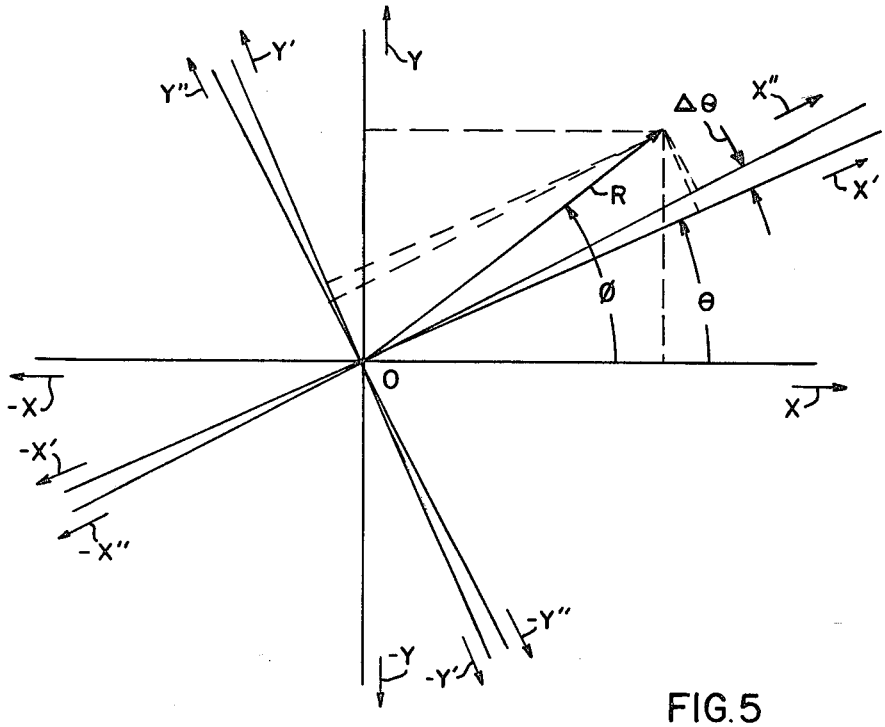
FIG. 5 is an illustration of a coordinate rotation through an angle theta plus delta.

In FIG. 5 X and Y represent the original values of the vector R in the original coordinate system. X' and Y' represent the values of the vector R in the second coordinate system. The original coordinate system is at an angle $\theta$ to the second coordinate system. However due to a misalignment in the measuring instrument with respect to the original coordinate system a $\Delta\theta$ angular displacement occurred and vector R must be additionally rotated through angle $\Delta\theta$. The values of vector R are Y'' and X''. The new values X'' and Y'' may be calculated using Equations 3 and 4 if the values of X, Y, $\theta$, and $\Delta\theta$ are known.

$$X'' = X\cos(\theta + \Delta\theta) + Y\sin(\theta + \Delta\theta) \quad (3)$$

$$Y'' = Y\cos(\theta + \Delta\theta) - X\sin(\theta + \Delta\theta) \quad (4)$$

Figure 6:
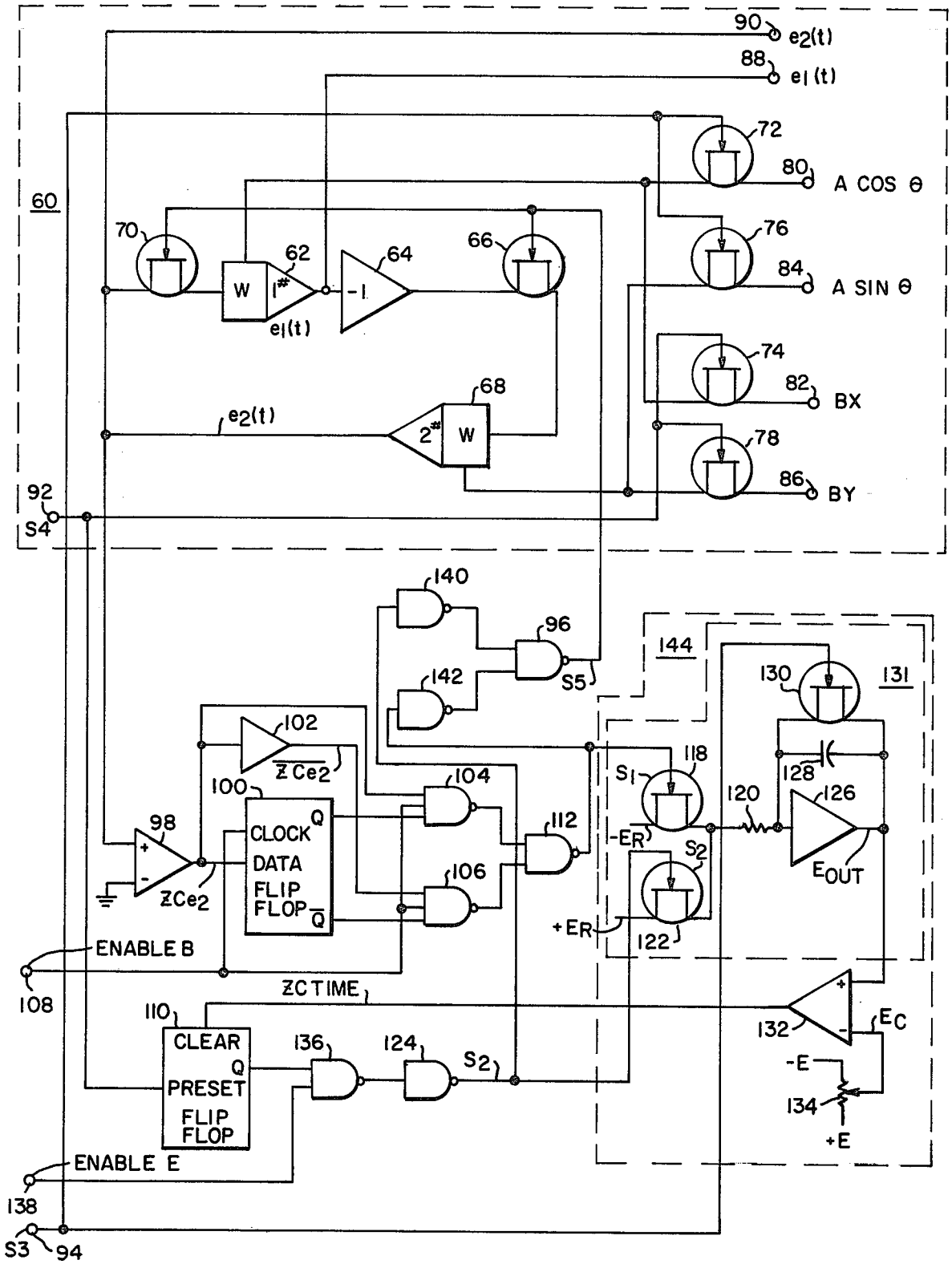
FIG. 6 is a schematic diagram of one embodiment of the invention.

Electronic apparatus for the transformation of a vector R from one coordinate system to another which includes means for compensating for angular misalignment is shown in FIG. 6.

The vector R to be transformed such as R in FIG. 5 may be expressed as a voltage BX and BY and placed on terminals 82 and 86. The angle $\theta$ through which the vector R is to be transformed is represented as a pair of voltage proportional to ACOS $\theta$ and ASIN $\theta$ and placed on terminals 80 and 84. The angular misalignment $\Delta\theta$ of the coordinate system may be represented as a plus or minus voltage $E_c$ obtained from the tap of potentiometer 134 and placed on one input of comparator 132. With proper time sequencing of control signals S3, ENABLE G, S4, and ENABLE E, the vector R will be transformed through an angle $\theta + \Delta\theta$ and the new coordinates of the vector R as shown by the intersection of the dotted lines with the axes will be proportional to the output voltages appearing on terminals 88 and 90 representing BX'' and BY''.

In FIG. 6, the output of integrator 62 having a gain W is connected to the input of inverter 64. The output of inverter 64 is connected through switch 66 to the input of integrator 68. The output of integrator 68 having a gain W is connected through switch 70 to the input of integrator 62. Switch 66 and switch 70 may be, for example, a field effect transistor (FET) including a voltage level driver in series with the gate which are commercially available. Switches 66 and 70 are controlled by signal S5 which functions to open or close the switches at appropriate times. As shown in FIG. 6, the output of NAND gate 96, signal S5, is connected to the gate of FET switch 66 and 70. The integrators 62 and 68 may be implemented with an input resistor connected in series with both an operationsl amplifier and a capacitor connected in parallel similar to the circuitry of integrator 131. With this circuit configuration the gain of the integrator is equal to 1/RC where R is the value of the resistor and C is the value of the capacitor. The gain of the integrator would be in units of volts per second per volt. The inverter may be implemented with an input resistor in series with both an operational amplifier and a resistor connected in parallel. The output of the operational amplifier connected to the resistor would serve as the inverter output. Voltages indicative of the angle $\theta$ (ACOS $\theta$ and ASIN $\theta$) and vector R (BX and BY) are connected or provided to the integrator 62 by switch 72 and switch 74 and connected or provided to integrator 68 by switch 76 and switch 78. The voltages are provided to integrators 62 and 68 by placing a voltage across the capacitor of each integrator at the proper time. Terminal 80 which is connected to a voltage representative of the cosine of the angle $\theta$ through which a vector R is to be rotated is connected to switch 72. Terminal 82 which is connected to a voltage representative of one of the coordinates of a vector to be rotated is connected to switch 74. Terminal 84 which is connected to a voltage representative of the sine of an angle $\theta$ through which vector R is to be rotated is connected to switch 76. Terminal 86 which is connected to a voltage representative of one of the coordinates of a vector R to be rotated is connected to switch 78. The output of integrator 62, $e_1(t)$, is connected to terminal 88 and at the proper time, has a voltage proportional to one of the coordinates of a rotated vector, such as BX''. The output of integrator 68, $e_2(t)$, is connected to terminal 90 and at the proper time, has a voltage proportional to one of the coordinates of a rotated vector, such as BY''. The control of switches 74 and 78 which may for example be the gate of a FET, is connected to terminal 92 which is connected to signal S4 which, at the proper time, (see FIG. 7) opens and closes switch 74 and switch 78. The control of switches 72 and 76 which may be the gate of a FET is connected to terminal 94. Signal S3 is connected to terminal 94 and the control of switches 72 and 76 which provides a voltage for opening and closing switches 72 and 76 at the proper times. The control of switches 66 and 70 is connected to the output of NAND gate 96, voltage signal S5, which controls the opening and closing of switches 66 and 70 at the proper times. The output of integrator 68 is connected to an input of comparator 98 having a second input connected to ground.

If all inputs to a NAND gate are a logic 1, then the output is a logic 0. If any input to a NAND gate is a logic 0, then the output is a logic 1. A logic 1 would be represented by a voltage from 3.5 to 5 volts and a logic 0 would be represented by a voltage from 0 to 0.3 volts. These voltage levels would be acceptable for transistor logic TTL which is commercially available. Voltage level drivers for the control of switches may be necessary to provide the necessary voltage swing to open and close the switch. While these drivers are not included in the logic, it is understood that they may be inserted in the logic prior to the control of a switch or gate of a FET.

The output of comparator 98 is connected to the data input of flip-flop 100, the input of inverter 102, and the input of NAND gate 104. The output signal of comparator 98 is identified as $ZCe_2$. The function of comparator 98 is to compare the input signal $e_2(t)$ with ground or zero voltage and when $e_2(t)$ is less than ground to have an output voltage of a logic one. Otherwise the output voltage would be a logic zero. Hence when $e_2(t)$ has a voltage above ground and crosses zero to below ground, an output of a logic one is observed at the output of comparator 98. The true output Q of flip-flop 100 is connected to an input of NAND gate 104. The complementary output for $\overline{Q}$ of flip-flop 100 is connected to an input of NAND gate 106. Flip-flop 100 functions to store $ZCe_2$ at the proper time as determined by the clock input signal, ENABLE B. Terminal 108 is connected to the clock input of flip-flop 100, to the input of NAND gate 104 and to the input of NAND gate 106. Terminal 108 is connected signal ENABLE B. The output of inverter 102, $\overline{ZCe_2}$, is connected to the input of NAND gate 106. The output of NAND gate 104 is connected to an input of NAND gate 112. The output of NAND gate 106 is connected go the input of NAND gate 112. The function of flip-flop 100, inverter 102, and NAND gates 104, 106 and 112 is to provide a signal, S1, at the output of NAND gate 112 when ENABLE B signal is a logic one and until the output of comparator 98, $ZCe_2$, changes logic state from either direction which may be expressed as a Boolean equation.

$$S1 = \text{ENABLE B}\ \{ZCe_2 \cdot Q + \overline{ZCe_2} \cdot \overline{Q}\} \quad (5)$$

When ENABLE B is a logic one and $ZCe_2$ changes state, signal S1 goes to zero. Signal S1 is connected to the control of switch 118. One side of switch 118 is connected to resistor 120 and the other side of switch 118 is connected to voltage reference $-E_R$. One side of switch 122 is connected to switch 118 and resistor 120 at their mutual connection point and the other side of switch 122 is connected to voltage $+E_R$. The control of switch 122 is connected to the output of NAND gate 124. The remaining side of resistor 120 is connected to the input of operational amplifier 126, to one side of capacitor 128 and to one side of switch 130. The control of switch 130 is connected to terminal 94. Switches 118, 122 and 130 are operated in the open and closed condition and may be field effect transistors including a voltage level drive, in series with the gate which are commercially available. The other side of switch 130 and capacitor 128 is connected to the output of operational amplifier 126 and to an input of comparator 132. Resistor 120, operational amplifier 126, capacitor 128, and switches 118, 122 and 130 function together as an integrator 131 where the gain K is equal to 1/RC having units of volts per second per volt. (R equals the value of resistor 120 and C equals the value of capacitor 128.

Figure 7:
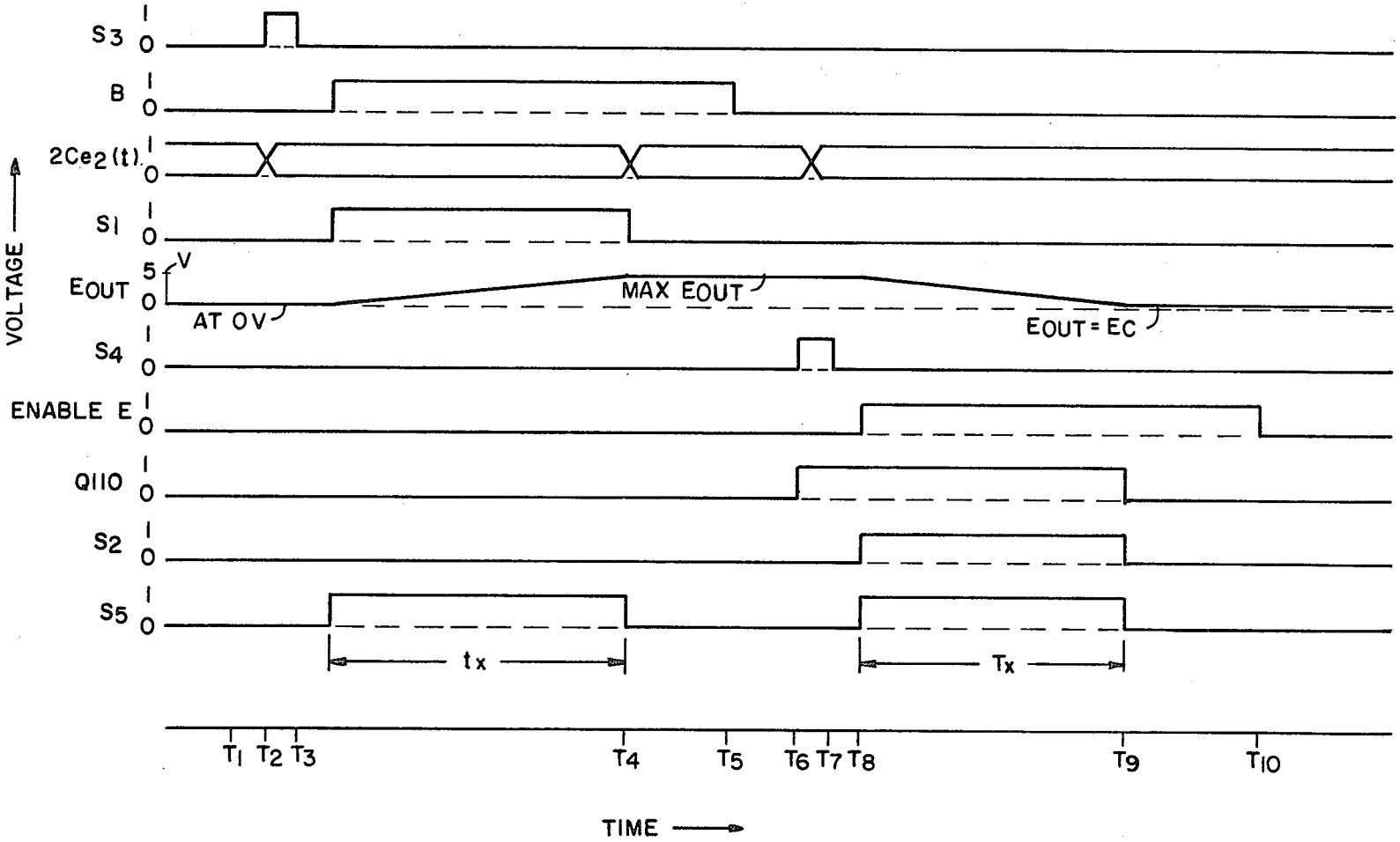
FIG. 7 is a set of waveforms illustrating operation of the embodiment shown in FIG. 6.

The tap of potentiometer 134, voltage $E_c$, is connected to an input of comparator 132 which represents an angular misalignment angle, $\Delta\theta$ which may be plus or minus. One side of potentiometer 134 is connected to voltage +E and the other side is connected to −E. The output of comparator 132, signal ZCTIME, is connected to the clear input of flip-flop 110. The true output Q of flip-flop 110 is connected to NAND gate 136. Terminal 138 is connected to a second input of NAND gate 136. The present input of flip-flop 110 is connected to terminal 92, signal S4. The output of NAND gate 136 is connected to the input of NAND gate 124. The output of NAND gate 124 is connected to the control of switch 122 and to the input of NAND gate 140. The output of NAND gate 112 is connected to the input of NAND gate 142. The output of NAND gate 140 is connected to an input of NAND gate 96 and the output of NAND gate 142 is connected to an input of NAND gate 96. The circuitry of time adjustment 144 as shown in FIG. 6 functions to store or record the time of the original pulse width of signal S1 during time period ENABLE B and to subsequently generate signal ZCTIME with the pulse width of signal S1 except modified in pulse width to compensate for angular misalignment $\Delta\theta$. Signal ZCTIME occurs during the time period when ENABLE E is a logic one as shown in FIG. 7. $\Delta\theta$ is represented by the value of voltage $E_c$ from the tap of potentiometer 134. The time adjustment 144 provides the time measurement of the oscillation angle and the time for coordinate rotation of the vector in the harmonic oscillator 60 as a function of the input angle $\theta$ and adjustment angle $\Delta\theta$.

The harmonic oscillator circuit 60 is well known in electronic engineering. It is also well known that this oscillator can be used as a coordinate converter. The equations of the output voltages of integrators 62 and 68 as a function of time and initial condition may be arrived at by expressing the voltages as a mathematical differential equation such as equations 6 and 7.

$$e_1(t) = -w \int e_2(t)\, dt + e_1(0) \quad (6)$$

$$e_2(t) = +w \int e_1(t)\, dt + e_2(0) \quad (7)$$

The solutions to the differential equations are found by using Laplace Transforms. Equations 8 and 9 provide the solution of equations 6 and 7 for $e_1(t)$ and $e_2(t)$.

$$e_1(t) = e_1(0) \cos wt - e_2(0) \sin wt \quad (8)$$

$$e_2(t) = e_1(0) \sin wt + e_2(0) \cos wt \quad (9)$$

The operation of the invention as disclosed in FIG. 6 may be described with reference to FIG. 7 which shows timing waveforms for several signals for the rotation of one vector through an angle $\theta + \Delta\theta$. Between times T1 and T2, signal S3 at terminal 94 is a logic one which closes switch 72 and switch 76 and switch 130 which initializes the voltages in integrator 62, 68 and 131 respectively. Integrator 62 is initialized with a voltage on terminal 80 representative of $A\cos\theta$. Integrator 68 is initialized with a voltage on terminal 84 representative of $A\sin\theta$, and integrator 130 is initialized with zero volts across capacitor 128. The voltages, $A\sin\theta$ and $A\cos\theta$ are DC voltages proportional to the sine and cosine of a measured angle $\theta$. Between T1 and T2, signal S4 on terminal 92 is a logic zero to hold switches 74 and 78 open. Signals ENABLE B and ENABLE E connect two terminals 108 and 138 respectively and logically control signals S1, S2 and S5 to be a logic zero which holds open switches 70, 66, 118 and 122. During this period signal $ZCe_2(t)$ may be either logic one or logic zero depending upon the initial conditions imposed on integrator 68. Signal $E_{out}$ is at zero volts since switch 130 is closed which completely discharges capacitor 128. When $E_{out}$ is greater than the voltage on the tap of potentiometer 134, Ec, the output of comparator 132, ZCTIME, is a logic one when ACTIME is a logic zero, flip-flop 110 is cleared and forces $Q_{110}$ to zero. With the integrator initialized to the proper voltages during T1 to T2, the harmonic oscillator 60 is allowed to oscillate by the closing of switches 70 and 66 which is controlled by signal S5 which occurs at T3 by ENABLE B. When ENABLE B goes to a logic one, the signal input to flip-flop 100 is stored and present at the output of flip-flop 100, Q, which in turn logically forces S1 to a logic one and S5 to a logic one which closes switches 118, 66 and 70. The closing of switches 66 and 70 allows harmonic oscillator 60 to oscillate. The closing of switch 118 allows integrator 131 to start integrating or charging. The integrator output $E_{out}$ is proportional to the duration of signal S1. When the output of integrator 68 crosses zero volts from either direction, comparator 98 will change logic state and the output, $ZCe_2$, will force signal S1 to a logic zero which will open switch 118 and stop integrator 131. The voltage $E_{out}$ of integrator 131 is a voltage representative of the time that harmonic oscillator 60 was allowed to oscillate. The time that signal $ZCe_2$ changes state after ENABLE B goes to a logic one at T3 is identified as time T4. The time that harmonic oscillator 60 is allowed to oscillate within period B or between the intervals T3 and T4 is known as $t_x$. At T5 ENABLE B goes to a logic zero which is long enough in time to allow the harmonic oscillator to oscillate such that signal $ZCe_2$ changes state. The loop stops oscillating when $e_2(t)$ equals zero volts. This occurs when $wt_x$ plus $\theta$ equals $\pi$ or $2\pi$. The time required for $e_2(t)$ to cross zero ($t_x$) is stored in integrator 131. $t_x$ may be expressed as shown in Equations 10 and 11.

$$t_x = \frac{\pi - \theta}{w} \qquad \text{For } 0<\theta<\pi \qquad (10)$$

$$t_x = \frac{2\pi - \theta}{w} \qquad \text{For } \pi<\theta<2\pi \qquad (11)$$

Switch 118 controlled by S1 applies a negative DC reference $-E_R$ to the input of integrator 131. At the end of $t_x$, $E_{out}$ is expressed by Equations 12 and 13 where K equals 1/RC.

$$E_{out} = KE_r t_x = \frac{KE_R}{w}(\pi - \theta) \qquad \text{For } 0<\theta<\pi \qquad (12)$$

$$E_{out} = \frac{KE_r}{w}(2\pi - \theta) \qquad \text{For } \pi<\theta<2\pi \qquad (13)$$

Signal S4 is a logic one from T6 to T7. Signal S4 closes switch 74 and switch 78 and allows the voltage on terminals 82 and 86 to be placed on integrators 62 and 68 respectively. The voltage on terminal 82 is BX and the voltage on terminal 86 is BY. BX and BY are voltages proportional to the orthogonal component (X, Y) of a vector that is to be transformed through the angle $\theta$ and a small correction angle $\Delta\theta$. S4 during T6 to T7 presets Flip-flop 110 to a logic one. Integrators 62 and 68 are initialized with voltages BX and BY while the loop is held open by switch 70 and switch 66 which is controlled by signal S5. Signal $ZCe_2(t)$ may change logic state due to the initial voltage placed on integrator 68. Since signal ENABLE B remains a logic zero, the signal $ZCe_2(t)$ has no effect on the subsequent operation of the harmonic oscillator 60 and signal S1 remains a logic zero.

At T8, ENABLE E goes to a logic one. NAND gate 136 with both inputs being a logic one has a zero output which forces the output of NAND gate 124, S2, to be a logic one. Signal S2 sets the output of NAND gate 140 to a logic zero which sets the output of NAND gate 96 to a logic one which is signal S5. Signal S5 closes switches 70 and 66 which starts the loop or harmonic oscillator 60 to oscillate. Signal S2 also closes switch 122 which connects the input of integrator 131 to a positive reference voltage $+E_R$. With a positive input reference voltage the output voltage of integrator 131, $E_{out}$, begins to discharge with the same rate as before of integrator 131, $E_R$/RC volts/second. The harmonic oscillator 60 or loop will continue to oscillate until signal S5 goes to a logic zero, which will occur when the signal S2 goes to the logic zero. While logic signal S2 is a logic one, the voltage output of integrator 131, $E_{out}$, is continually decreasing and is compared to $E_c$ in comparator 132. $E_c$ is a voltage representative of the correction angle $\Delta\theta$. If there is no correction angle or if $\Delta\theta$ is zero, then $E_c$ would be zero volts. The comparator 132 switches to a logic zero output when $E_{out}$ becomes slightly less than $E_C$. When $E_{out}$ is greater than $E_C$, ZCTIME is a logic one. When the output of comparator 132, ZCTIME, switches to a logic zero, flip-flop 110 is cleared which sets signal $Q_{110}$ to a logic zero, which in turn causes signal S2 to go to a logic zero at time T9. It is understood that there is some delay between logic signals, for example, $Q_{110}$, signal S2, and signal S5 due to signal propogation delay time through the logic circuits. Signal S5 goes to a logic zero at T9 which opens up switches 70 and 66. The output voltage of integrator 62, $e_1(t)$ and of integrator 68, $e_2(t)$ are voltages proportional to the orthogonal components, BX", BY", of a vector R that has been transformed through the angle $\theta$ plus $\Delta\theta$. The period of time that harmonic oscillator 60 oscillates with initial conditions BX and BY on integrators 62 and 68 which occurs from time T8 to time T9 is known as $T_x$ as shown on FIG. 8. Signal ENABLE E remains a logic one until time T10 which is after S2 goes to a logic zero at T9. $T_x$ is variable over a period of time due to the variation in $\theta$ and $\Delta\theta$ which determines the amount of rotation of the vector R.

If the voltage $E_c$ which is proportional to $\Delta\theta$ on the input of comparator 132 is equal to $KE_R\Delta\theta/w$, then the duration $T_x$ of the rotation time of the loop shown in Equation 14.

$$T_x = \frac{1}{KE_R}\left[E_{out} - \frac{KE_R\Delta\theta}{w}\right] \qquad (14)$$

Substitution of Equation 12 into Equation 14 yields Equation 15.

$$WT_x = \pi - \theta - \Delta\theta \qquad (15)$$

Substitution of Equation 13 into Equation 14 yields Equation 16.

$$WT_x = 2\pi - \theta - \Delta\theta \qquad (16)$$

Since at T8, at the start of the rotation of the vector R, $e_1(0)$ equal BX and $e_2(0)$ equals BY, substitution of Equation 15 into Equations 8 and 9 yields Equations 17 and 18 which are the coordinate Equations 3 and 4 of a vector R where X'' equals minus $e_1/B$ and Y'' equals minus $e_2/B$.

$$X'' = -e_1/B = X\cos(\theta + \Delta\theta) + Y\sin(\theta + \Delta\theta) \quad (17)$$

$$Y'' = -e_2/B = Y\cos(\theta + \Delta\theta) - X\sin(\theta + \Delta\theta) \quad (18)$$

Substitution of Equation 16 into Equations 8 and 9 yields Equations 17 and 18 except for the negative values, $-e_1/B$ and $-e_2/B$ are positive values, $e_1/B$ and $e_2/B$ respectively. X'' is equal to $e_1/B$ and Y'' is equal to $e_2/B$.

Figure 8:
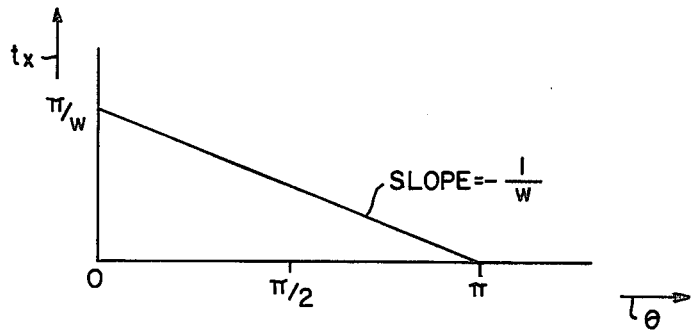
FIGS. 8 and 9 are graphs showing the relationship of time versus coordinate rotation.
Figure 9:
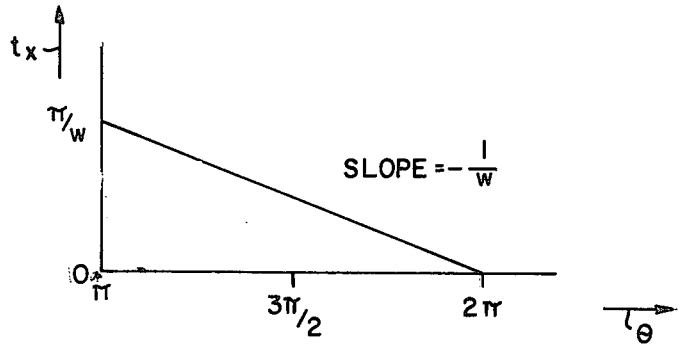
Figure 10:
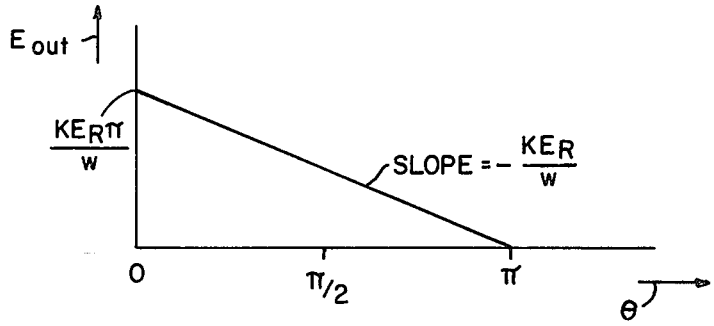
FIGS. 10 and 11 are graphs showing the relationship of voltage versus coordinate rotation; and, FIG. 12 is a graph showing the relationship of vector rotation time $T_x$ versus $\Delta\theta$, the connection angle.
Figure 11:
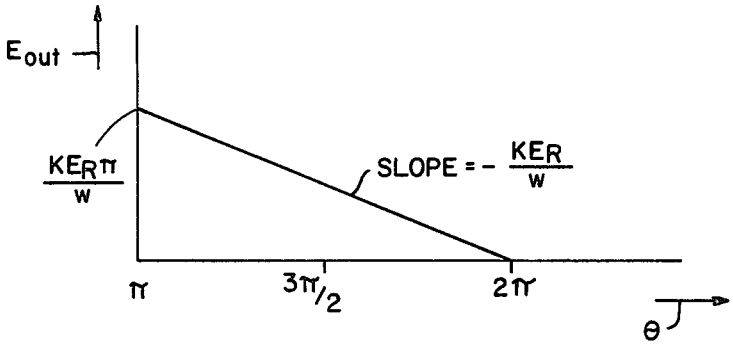

A graphical representation of Equation 10 is shown in FIG. 8. A graphical representation of Equation 11 is shown in FIG. 9. $t_x$ represents the amount of time required to rotate vector R through a given angle $\theta$ during the time when ENABLE E is a logic one if there is no angle correction or if $\Delta\theta$ is zero. A graphical representation of Equation 12 is shown in FIG. 10 and a graphical representation of equation 13 is shown in FIG. 11. $E_{out}$ represents the voltage output of integrator 131 after ENABLE B goes to zero at T5 and represents the angle through which a vector R is rotated when ENABLE E is a logic one. It can be seen that $E_{out}$ is a substitute parameter for time $t_x$. By modifying the time $t_x$ by a small amount, it can be seen that $\theta$ is varied by a small amount $\Delta\theta$. If Equations 10 and 11 were substituted into Equations 15 and 16, respectively, the result is represented by Equation 19.

$$T_x = t_x - \frac{\Delta\theta}{w} \quad (19)$$

Figure 12:
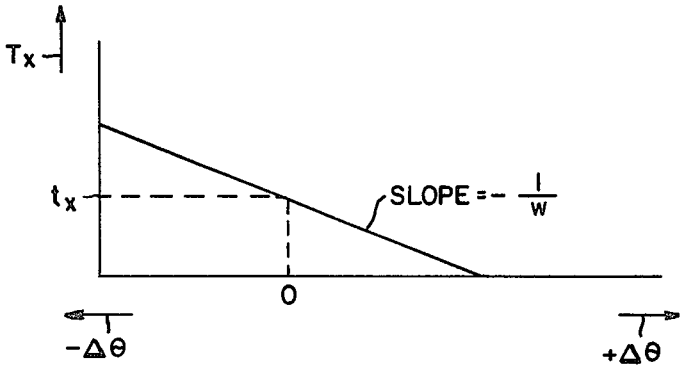

Equation 19 is graphically represented in FIG. 12 where the time $T_x$ is shown in relation to $\Delta\theta$, the correction angle to the rotation of a vector through an angle $\theta$.

The embodiment of FIG. 6 may be modified by replacing the circuitry in time adjustment 144 with a counter to count the duration of the signal S1 in the logic one state from T3 to T4, and by providing means for adjusting the counter with an increment plus or minus in the counter or $\Delta T$. The counter would provide signal ZCTIME for $T_x$ during signal ENABLE E controlling signal S2 through the duration of $T_x$. The $\Delta T$ used to adjust the counter could be stored in a register. The final count of the duration of S1 would be a parameter proportional to $E_{out}$ and the plus or minus in the counter or $\Delta T$ would be a parameter proportional to $E_C$.

In accordance with the schematic diagram of the invention in FIG. 6, a vector may be transformed through a measured angle $\theta$ which may be modified during the transformation to compensate for angular misalignment $\Delta\theta$. $\Delta\theta$ may be expressed as either a voltage or an increment of time which is utilized to modify the oscillation time of a harmonic oscillation during rotation of the vector coordinates.

We claim as our invention:

1. Electronic apparatus for transforming vectors through corrected angles where the measured angle is with reference to a first coordinate system which is angularly misaligned with a desired second coordinate system and where the measured angle is corrected while the vector is being transformed to a third coordinate system comprising:

electronic coordinate converter means for electrically transforming said vector from said first coordinate system to said third coordinate system;

said converter means including means for generating misalignment signals indicative of said angular misalignment and means for adjusting the transformation of said vector to modify the transformation angle during a single angle transformation to compensate for said angular misalignment.

2. The electronic apparatus of claim 1 wherein said converter means includes a harmonic oscillator;

said means for adjusting the transformation of said vector includes an integrator with an output connected to a first input of a comparator, said misalignment signals connected to a second input of said comparator, said integrator operable to store a voltage indicative of the oscillation angle of the harmonic oscillator, said integrator operable to change its output voltage at a constant rate during oscillation of the vector coordinates in the harmonic oscillator whereby the comparator will provide a signal when the integrator output voltage is less than said misalignment signals indicating the vector is transformed to a third coordinate system.

3. A harmonic oscillator coordinate converter apparatus comprising:

a first integrator, a second integrator, and an inverter connected in a loop;

means for inserting first initial conditions onto said integrators representative of an angle $\theta$;

means for detecting a voltage in said loop;

means for starting a first loop oscillation;

mmeans for storing the time $t_x$ of said first loop oscillation from said first initial conditions to a predetermined loop condition;

means for inserting second initial conditions onto said integrators representative of a vector R;

means for starting a second loop oscillation for a time $t_x$ whereby the vector R will be rotated through an angle $\theta$;

means for varying the second loop oscillation time $t_x$ by an amount $\Delta T$ representative of a coordinate adjustment angle $\Delta\theta$ whereby the vector R is rotated through an angle $\theta + \Delta\theta$.

4. The electronic apparatus of claim 3 wherein said means for detecting a voltage in said loop includes a comparator;

said means for storing the time $t_x$ includes a clock and a counter;

said means for varying the second loop oscillation time $t_x$ by an amount $\Delta T$ includes a means for adjusting the counter by an amount $\Delta T$.

5. The electronic apparatus of claim 3 wherein said means for detecting a voltage in said loop includes a comparator;

said means for storing the time $t_x$ includes an integrator having an output signal;

said means for varying the second loop oscillation time $t_x$ by an amount $\Delta T$ includes means for comparing the output voltage of said integrator with a voltage indicative of $\Delta T$.

6. Resolver apparatus for transforming vectors comprising:

a harmonic oscillator coordinate converter;

means for varying the time of oscillation of said harmonic oscillator when a vector is rotated to provide a coordinate adjustment angle $\Delta\theta$ to said vector transformation wherein said means for varying the time of oscillation includes a clock and counter for storing the time of oscillation and means for adjusting the value stored in the counter by an amount indicative of the adjustment angle $\Delta\theta$.

7. Resolver apparatus for transforming vectors comprising:

a harmonic oscillator coordinate converter;

means for varying the time of oscillation of said harmonic oscillator when a vector is rotated to provide a coordinate adjustment angle $\Delta\theta$ to said vector transformation wherein said means for varying the time of oscillation includes an integrator for storing the time of oscillation and means for comparing the output voltage of the integrator with a voltage indicative of $\Delta\theta$.

8. In a harmonic oscillator coordinate converter including a first integrator, a second integrator, and an inverter connected in a loop, means for intializing said integrators at a time prior to period A and after period A and at a time prior to period B, means for detecting the voltage output of said second integrator, means for storing the time $t_x$ of oscillation from said initial conditions to a predetermined loop condition during time period A, wherein the improvement comprises means for varying the time of oscillation during time period B from the time $t_x$ to a time $t_x \pm \Delta T$ where $\Delta T$ is representative of a coordinate adjustment angle $\Delta\theta$.

9. The harmonic oscillator coordinate converter of claim 8 wherein said means for varying the time of oscillation of time period B includes a clock and counter for storing the time $t_x$ of oscillation and means for adjusting the time stored in the counter by an amount indicative of the time $\Delta T$.

10. The harmonic oscillator coordinate converter of claim 8 wherein said means for storing the time $t_x$ includes an integrator and said means for varying the time of oscillation of time period B includes means for comparing the output voltage of the integrator with a voltage indicative of $\Delta\theta$.

11. The electronic apparatus of claim 1 wherein said converter means includes a harmonic oscillator;

said means for adjusting the transformation of said vector includes an integrator with an output coupled to said misalignment signals to form a summed signal which is connected to an input of said comparator, said integrator operable to store a voltage indicative of the oscillation angle of the harmonic oscillator, said integrator operable to change its output voltage at a constant rate during oscillation of the vector coordinates in the harmonic oscillator whereby the comparator will provide a signal when the summed signal is less than a predetermined voltage.

* * * * *